US011731448B2

(12) United States Patent
Schwake

(10) Patent No.: US 11,731,448 B2
(45) Date of Patent: Aug. 22, 2023

(54) APPARATUS AND METHOD FOR AUTOMATED PRODUCTION OF BOOK COVERS AND/OR BOX LIDS

(71) Applicant: KOLBUS GMBH & CO. KG, Rahden (DE)

(72) Inventor: Thomas Schwake, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 17/764,068

(22) PCT Filed: Sep. 23, 2020

(86) PCT No.: PCT/EP2020/076480
§ 371 (c)(1),
(2) Date: Mar. 25, 2022

(87) PCT Pub. No.: WO2021/058510
PCT Pub. Date: Apr. 1, 2021

(65) Prior Publication Data

US 2022/0371352 A1 Nov. 24, 2022

(30) Foreign Application Priority Data

Sep. 26, 2019 (DE) ..... 10 2019 126 034.5

(51) Int. Cl.
*B42C 7/00* (2006.01)
*B42C 11/04* (2006.01)
*B42C 19/06* (2006.01)

(52) U.S. Cl.
CPC ..... *B42C 11/04* (2013.01); *B42C 7/00* (2013.01); *B42C 7/002* (2013.01); *B42C 7/006* (2013.01); *B42C 7/008* (2013.01); *B42C 19/06* (2013.01)

(58) Field of Classification Search
CPC ..... B42C 7/00; B42C 7/006; B42C 7/008
See application file for complete search history.

(56) References Cited

U.S. PATENT DOCUMENTS 3,195,924 A 7/1965 Carter et al.
2002/0061239 A1* 5/2002 Bohn ..... B42C 19/08 412/19

(Continued)

FOREIGN PATENT DOCUMENTS

DE 10057599 A1 5/2002
DE 102010024232 A1 12/2011

(Continued)

OTHER PUBLICATIONS

PCT International Search Report and Written Opinion for International Application No. PCT/EP2020/076480 filed Sep. 23, 2020, dated Dec. 7, 2020, 16 pgs.

(Continued)

*Primary Examiner* — Kyle R Grabowski
(74) *Attorney, Agent, or Firm* — Alix, Yale & Ristas, LLP

(57) ABSTRACT

The invention relates to a case maker comprising a cardboard feed, a blank feed, a glue applicator, the joining device, a turn-in device, a delivery unit and a control unit, with a spreading device of the cardboard feed being arranged downstream of a first cardboard cutting mechanism in the product flow in order to position the cardboard blanks produced from a common cardboard sheet by means of the first cardboard cutting mechanism spaced apart from one another.

9 Claims, 2 Drawing Sheets

(56) References Cited

U.S. PATENT DOCUMENTS

| | | | | |
|---|---|---|---|---|
| 2002/0061240 | A1* | 5/2002 | Beermann | B42C 7/00 412/19 |
| 2010/0111643 | A1* | 5/2010 | Schmidkonz | B42C 11/04 412/17 |
| 2011/0311336 | A1* | 12/2011 | Tautz | B42C 7/008 412/17 |
| 2012/0170995 | A1* | 7/2012 | Albert | B26D 1/151 412/4 |

FOREIGN PATENT DOCUMENTS

| | | | | |
|---|---|---|---|---|
| DE | 202011001160 | U1 | 4/2012 | |
| DE | 102011118316 | A1 * | 5/2013 | B42C 7/004 |

OTHER PUBLICATIONS

"Casemaker with horizontal processing principle", Liebau, Heinze; Industrielle Buchbinderei; Verlag Beruf und Schule, 1997; pp. 399, 14 pgs.

* cited by examiner

APPARATUS AND METHOD FOR AUTOMATED PRODUCTION OF BOOK COVERS AND/OR BOX LIDS

BACKGROUND

The present invention relates to an apparatus according to the preamble of claim 1 and to a method according to the preamble of claim 8.

In a case maker with horizontal processing principle [Liebau, Heinze; Industrielle Buchbinderei; Verlag Beruf and Schule, 1997; pp. 399], case boards and a spine strip of pasteboard or cardboard are joined with the glued blanks to be covered in a precisely fitted manner in a roll-down mechanism. A case maker of the initially described type is furthermore illustrated and described in DE 100 57 599 A1. The case boards are pushed out of a cardboard magazine and fed to the roll-down mechanism together with the spine strip while being laterally aligned on guide rails. The blank to be covered is transported into the roll-down plane synchronous with the cardboard feed by means of a blank cylinder. The protruding edges of the book cover are subsequently turned in either in a flowing throughput or at a respective standstill in successively arranged workstations, wherein the edges protruding at the head and the foot typically are turned in first and the edges protruding on the sides are subsequently turned in after cornering has taken place. The book covers are ultimately guided between pressing rollers of a rub-down mechanism in order to rub down the cardboard parts on the blanks to be covered. The finished book covers are then transported in the form of a stack to a manual removal station in a delivery unit by means of a roller table.

Case makers of this type serve for the mass production of identical book covers or box lids with high production capacity. The uninterrupted production of different book covers or box lids is possible if they have the same format, i.e. the same dimensions with respect to their opened width, height, case width and spine strip width, and the supplied blanks to be covered of the same format merely differ with respect to the printed content. Known case makers therefore are always set up for a certain case format in a fixed manner.

During a format change, the case maker is reset to the new dimensions while it is at a standstill. Although the essential resetting processes in case makers of the initially described type are in the meantime automated with the aid of motorized adjusting systems and a central control unit and essentially take place in parallel, each format change is still associated with a time-consuming changeover process that is economically disproportionate to the actual production time, particularly when producing small editions of only a few book covers of the same format.

DE102010024232A1 proposes to position guide elements in accordance with a respective book cover to be produced in a time-adapted manner during continuous production. In this case, a respective adjustment is carried out as soon as the respective processing of the previous case or case parts is completed. The uninterrupted production of book covers with different opened widths is possible due to this type of resetting of the guides of the cardboard feed that align the case boards and the spine strips, as well as of the turn-in mechanisms of the side turn-in station. In this case, the format of the case boards is neither variable with respect to their height nor with respect to their width during continuous production. The different opened widths are merely achieved by changing the position of the case boards relative to one another.

SUMMARY OF THE INVENTION

The invention is based on the objective of developing an apparatus and a method for the automated production of book covers and/or box lids of the initially described type, wherein said apparatus and method allow the industrial production of book covers of different formats with high quality.

This objective is attained by means of an inventive apparatus with the features of claim 1 and by means of an inventive method with the features of claim 8. Advantageous enhancements of the invention are characterized by the features specified in the dependent claims.

BRIEF DESCRIPTION OF THE DRAWINGS

An exemplary embodiment of the invention is described below with reference to the figures, to which we refer with respect to all details that are not elucidated in the description. In these figures.

DETAILED DESCRIPTION

Figure 1:
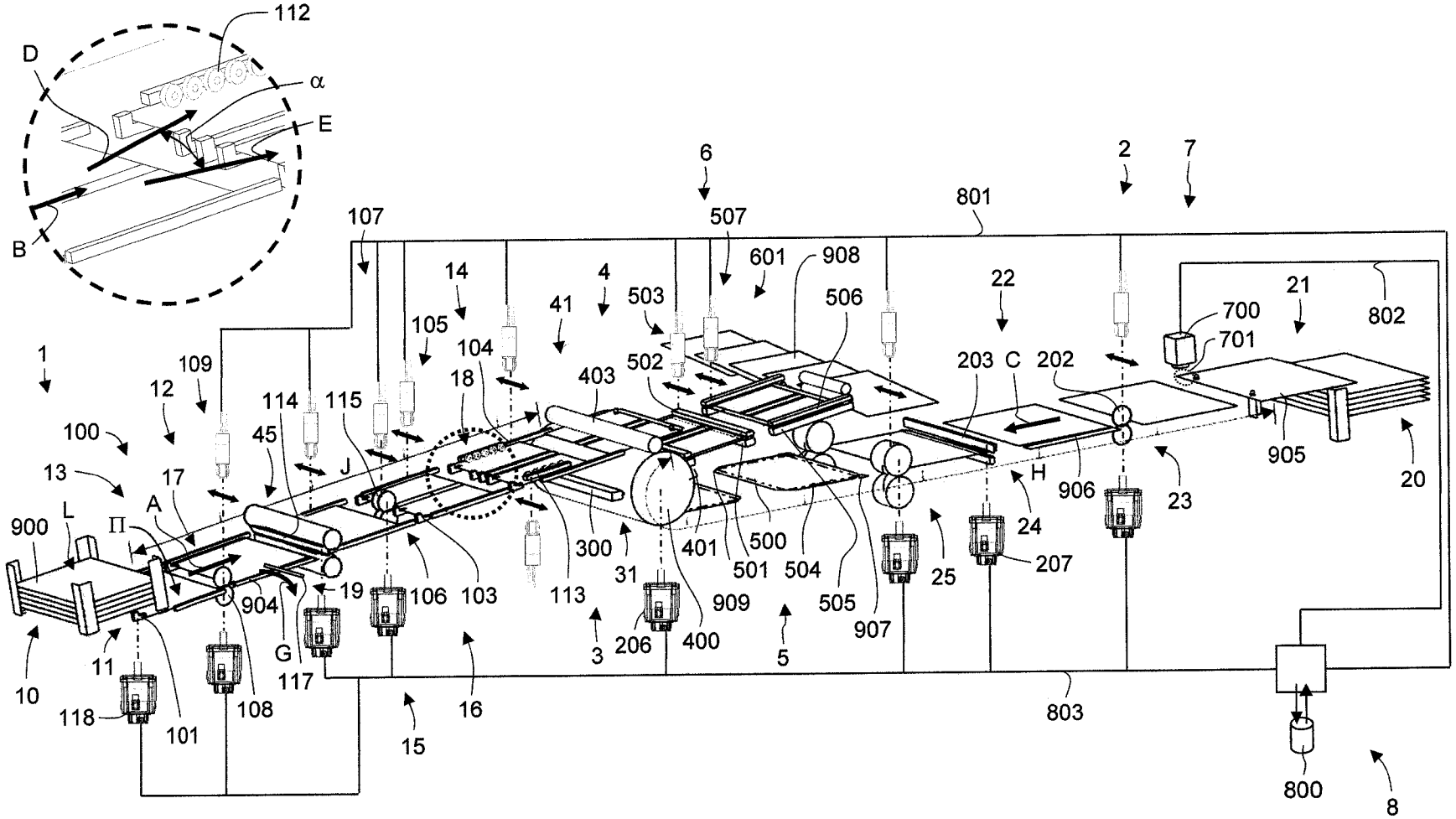
FIG. 1 shows a schematic representation of a case maker.

The case maker schematically illustrated in FIG. 1 respectively processes an untrimmed cardboard sheet 900 and an untrimmed blank sheet 905 into a multipart case 908. It allows the continuous production of cases with different formats, i.e., while the machine is running and cases with different formats are processed from untrimmed cardboard sheets and untrimmed blank sheets with the same formats. To this end, it comprises a cardboard feed 1, a blank feed 2, a glue applicator 3 that is arranged along the transport path of the blanks and a joining device 4, as well as a turn-in device 5 and a delivery unit 6. The control unit 8 serves for controlling the driving motors 118, 206, 207 and the adjusting mechanisms 105, 107, 109, 119, 121, 503, 507, as well as additional actuators 300 of the different devices 1, 2, 3, 5 of the case maker. The devices 1, 2, 3, 5 of the case maker are described below.

The cardboard feed 1 has a cardboard magazine 10. This cardboard magazine 10 stores a stack of untrimmed cardboard sheets 900 with the same format. A first separating mechanism 11 separates the respective lowermost untrimmed cardboard sheet 900 from the supply stack. First transport elements 101 push this lowermost untrimmed cardboard sheet 900 underneath the stack in a first cardboard transport direction A. The cardboard transport mechanism 12 following the cardboard magazine 10 receives the respectively separated untrimmed cardboard sheet 900 and transfers it to the joining device 4.

The cardboard transport mechanism 12 has a first transport section 13 and a second transport section 14 with a second transport direction B of the cardboards 900, 901, 902, 903, wherein said transport sections are successively arranged in the downstream direction. The second transport direction B is collinear to the ejecting direction A of the first separating mechanism 11.

A cardboard cutting device 15 with a first longitudinal cutting mechanism 16 is arranged along the cardboard transport mechanism 12 downstream of the first separating mechanism 11 referred to the first cardboard transport direction A. This first longitudinal cutting mechanism 16 is arranged in the region of the second transport section 14 and comprises two first rotary cutters 106. The upper circular knives 115 and the lower circular knives of the two first rotary cutters 106 respectively have the same rotational axis. The rotational axis of the upper circular knives 115 and the rotational axis of the lower circular knives extend parallel to the cardboard transport plane || and transverse to the cardboard transport direction A, B.

The two first rotary cutters 106 are arranged in the cardboard transport path and spaced apart from one another along the common rotational axes in such a way that the supplied cardboard sheets are during their passage respectively separated into three cardboard elements 901, 902, 903.

Each of the first rotary cutters 106 is drive-connected to a respective adjusting mechanism 107. The adjusting mechanisms 107 are connected to the control unit 8 of the case maker in a controllable manner via a first data line 801. They respectively have conventional adjusting elements, e.g., spindle drives, with adjusting directions extending transverse to the second cardboard transport direction B of the cardboards 900 in the second transport section 14.

Figure 2:
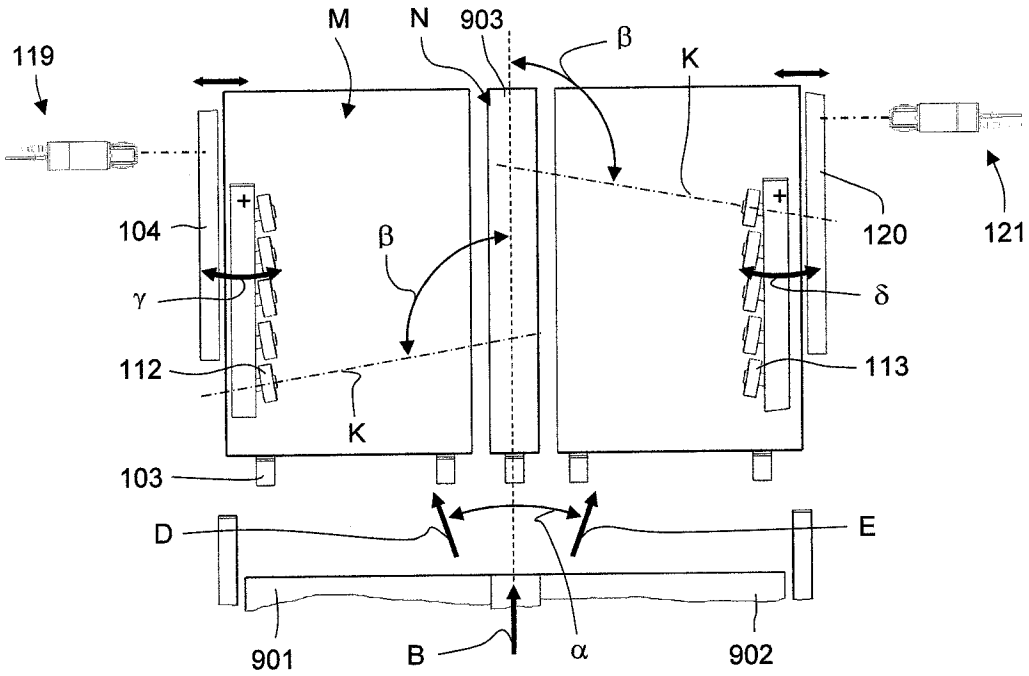
FIG. 2 shows a schematic top view of a spreading device.

A spreading device 18 according to FIG. 2 is arranged downstream of the first longitudinal cutting mechanism 16. This spreading device 18 positions cardboard elements 901, 902, 903 of the same case relative to one another transverse to the second transport direction B.

To this end, it creates different transport directions D, E of the outer cardboard elements 901, 902, which are oriented in a common plane with the second transport direction B. The fourth transport direction D and the fifth transport direction E therefore do not extend parallel to one another, but rather include a spread angle $\alpha$.

This spread angle $\alpha$ between the fourth transport direction D and the fifth transport direction E is greater than 0°. It is formed by left guide rollers 112 and by right guide rollers 113. The left guide rollers 112 and the right guide rollers 113 are respectively mounted in a rail above the cardboard transport plane || in such a way that they exert a normal force upon the outer cardboard elements 901, 902 to be transported. The rotational axes K of the guide rollers 112, 113 have a lead angle $\beta$ relative to the second transport direction B. This lead angle $\beta$ can be changed by pivoting the respective rail with the guide rollers 112, 113 about an axis oriented perpendicular to the cardboard plane by a rotation angle $\gamma$, $\delta$, Conventional adjusting mechanisms are provided for this adjustment of the lead angle $\beta$, but not illustrated in the figures.

The displacement of the cardboard elements 901, 902 transverse to the second transport direction B by means of the spreading device 18 is limited by a second guide rail 104 and by a third guide rail 120. The guide rollers 112, 113 respectively push the corresponding cardboard element 901, 902 laterally against the second guide rail 104 and against the third guide rail 120, which respectively define the lateral position and the angular position of the corresponding cardboard element 901, 902. The second guide rail 104 can be positioned transverse to the second transport direction B by means of a sixth controllable adjusting mechanism 119 and the third guide rail 120 can be correspondingly positioned by means of a seventh controllable adjusting mechanism 121 in order to realize the adaptation to different formats and different lateral distances between the cardboard elements 901, 902, 903 of a case. The sixth controllable adjusting mechanism 119 and the seventh controllable adjusting mechanism 121 are connected to the control unit 8 of the case maker via data lines 801.

A second longitudinal cutting mechanism 17 is arranged along the cardboard transport path between the first separating mechanism 11 and the first longitudinal cutting mechanism 16. It comprises a second cutting tool 108 in the form of a rotary cutter. The second cutting tool 108 can be positioned transverse to the second transport direction B. To this end, it is provided with a third controllable adjusting mechanism 109. This third controllable adjusting mechanism 109 is also connected to the control unit 8 of the case maker via a first data line 801. In this way, the second cutting tool 108 also can be automatically adjusted to a desired cardboard format during ongoing production.

The cardboard feed 1 is provided with a first discharge mechanism 19 downstream of the second longitudinal cutting mechanism 17. The first discharge mechanism 19 removes the section 904 separated from the cardboard in the second longitudinal cutting mechanism 17 from the first cardboard transport path 100. To this end, a rail in the form of a diverter element 117 is arranged such that it penetrates the first cardboard transport path 100 from the top toward the bottom. The diverter element 117 is stationary with respect to the individual cut, but can be transversely displaced for a format adjustment.

The cardboard feed 1 furthermore has a first transverse cutting mechanism 45 within the first cardboard transport path 100. The transverse cutting mechanism 45 makes it possible to cut the untrimmed cardboard sheets 900 to a desired smaller sheet height. The transverse cutting mechanism is formed by a pair of interacting cutting cylinders with respective knives 114 arranged on their circumference. The cutting cylinders extend over the first cardboard transport path 100 transverse to the first transport direction A. A controllable drive is assigned to these cutting cylinders. A variable, non-uniform motion profile of the rotation makes it possible to easily cut the cardboards to different heights in a cyclically successive manner. Another discharge mechanism removes the section from the first cardboard transport path 100, but is not illustrated in the figures in order to provide a better overview.

The cutting mechanisms 16, 17, 45 enable the case maker to produce cases 908 of different formats from a uniform format of the untrimmed cardboard sheets 900. It is therefore not necessary to stock different untrimmed cardboard formats. Furthermore, no format-related adjustment of the cardboard magazine 10 is required.

The case maker is equipped with a blank feed 2, which with respect to the joining device lies opposite of the cardboard feed 1. The untrimmed blank sheets 905 are stored in the blank magazine 20 in the form of a stack. A second separating mechanism 21 is located above the blank magazine 20. This second separating mechanism separates the respective uppermost sheet from the remaining blank stack and feeds it to a transport mechanism 22.

A third longitudinal cutting mechanism 23 is provided along its transport direction C downstream of the blank separating mechanism 21. It is equipped with a rotary cutter 202, which can be positioned transverse to the blank transport direction C, just like the second longitudinal cutting mechanism 17. To this end, another controllable adjusting mechanism is assigned to the rotary cutter 202. This third longitudinal cutting mechanism 23 enables the case maker to cut a supplied untrimmed blank sheet 905 to the required blank width.

A second transverse cutting mechanism 24, which is arranged downstream of the third longitudinal cutting mechanism 23 referred to the transport direction C, makes it possible to cut the untrimmed blank sheet 905 to the required blank height. The second transverse cutting mechanism 24 is formed by a knife 203 that cuts against a stationary cutting bar. In this way, an untrimmed blank format can be cut into arbitrary smaller blank formats in conjunction with the third longitudinal cutting mechanism 23.

A corner cutter 25 is arranged downstream in the product flow. It comprises two pairs of coaxial cutting cylinders, which are variably spaced apart from one another and respectively have two helically designed blades. The two helical blades of a cylinder are arranged opposite of one another and pitched in opposite directions. The corner cutter 25 also has a controllable individual drive. Consequently, the corners of the leading and the trailing edges of the blank sheet can be cut off in transit by means of diagonally extending cuts.

The blank transport mechanism 22 feeds the separated blanks to the glue applicator 3 through the cutting mechanisms 23, 24, 25. To this end, a blank cylinder 400 with grippers 401 respectively fixes the leading edge of the pre-cut blank and guides this pre-cut blank along the glue applicator 3 with its lateral area. This glue applicator is formed by nozzles 300 that are assembled into a beam. However, a roller-type type glue applicator of conventional design may also be used.

The cardboard feed direction a, B is tangent to the blank cylinder 400 in such a way that the glued pre-cut blank is in transit rolled down on the cardboard elements. In this case, a counterpressure shaft 403 arranged in the joining region exerts an additional pressure upon the parts to be glued together.

The thusly produced workpiece passes through the turn-in device 5 of the case maker. This turn-in device comprises two turn-in mechanisms, 50, 51 of conventional design. The head and foot turn-in device follows the joining device 4. Rails 501 extending transverse to the transport direction B of the cardboard elements 901, 902, 903 set the leading and trailing protrusions of the glued blank upright along the first bending lines 500 formed by cardboard edges due to an essentially vertical motion relative to the cardboard elements 901, 902, 903. Turn-in rails 502 fold over the upright protrusions onto the inner side of the case due to linear motions parallel to the transport direction B of the cardboard elements 901, 902, 903 and rub down said protrusions on the cardboard elements 901, 902, 903.

Controllable adjusting mechanisms 503, 507 are assigned to all turn-in elements 501, 502, 505, 506 and position said turn-in elements in accordance with the case format to be produced.

The parts complex is subsequently transferred into the side turn-in mechanism and deposited on support rails 505. Second turn-in rails 506 pivot on the cases 901, 902 from a starting position underneath the lateral cardboard protrusions. In the process, they take hold of the lateral blank protrusions and turn them in on the cardboards 901, 902 along the lateral bending lines 504.

The turned-in cases 908 pass through a roll-down mechanism that is arranged downstream of the turn-in device 5 and presses the parts 901, 902, 903, 909 to be glued together against one another in transit. A downstream delivery unit 6 transports the cases 908 out of the case maker in order to make them available for further processing or intermediate storage.

The magazines 10, 20, as well as the delivery unit 6, are arranged at approximately the same ergonomic height in order to allow convenient operability thereof. To this end, the transport directions A, B, C, D, E of the cardboard feed 1 are oriented in an ascending manner from the cardboard magazine 10 to the joining device 4.

The case maker also comprises a control unit 8 with a data memory 800, wherein production parameters and format data associated with the production orders of cases 908 produced and to be produced, as well as their individual parts 901, 902, 903, 909 and starting materials 900, 905, are stored in said data memory.

All controllable adjusting mechanisms 105, 107, 109, 503, 507 are connected to the control unit 8 via first data lines 801 and all controllable drives 118, 205, 206, 207 are connected to the control unit via additional data lines 803. The control unit 8 uses these data lines for delivering product-dependent and production-dependent nominal values, which are based on the data stored in the data memory 800, to the drives 118, 205, 206, 207 and the adjusting mechanisms 105, 107, 109, 503, 507. Actual values are transmitted to the control unit 8.

A detection device 700 is provided in the region of the blank feed 2. This detection device detects an identification provided on a blank 905 as soon as the blank 905 passes through its detection area 701. For example, the detection device 700 used may be a camera that reads the respective datamatrix code printed on the blank and transmits the acquired information to the control unit 8 via a data line 802. Nominal value settings for the drives 118, 205, 206, 207 and the adjusting mechanisms 105, 107, 109, 503, 507 are determined based on the identification and transmitted to these drives and adjusting mechanisms.

LIST OF REFERENCE SYMBOLS

1 Cardboard feed
2 Blank feed
3 Glue applicator
4 Joining device
5 Turn-in device
6 Delivery unit
7 Reader
8 Control unit
10 Cardboard magazine
11 First separating mechanism
12 Cardboard transport mechanism
13 First transport section
14 Second transport section
15 Cardboard cutting device
16 First longitudinal cutting mechanism
17 Second longitudinal cutting mechanism
18 Spreading device
19 First discharge mechanism
20 Blank magazine
21 Second separating mechanism
22 Blank transport mechanism
23 Third longitudinal cutting mechanism
24 Second transverse cutting mechanism
25 Corner cutter
26 Second discharge mechanism
30 Glue tank
31 Glue delivery mechanism
32 Glue metering mechanism
40 Positioning mechanism
41 Roll-down mechanism
45 First transverse cutting mechanism
50 First turn-in mechanism
51 Second turn-in mechanism
100 First transport path
101 First transport element
102 Second transport path
103 Second transport element

104 Second guide rail
105 First controllable adjusting mechanism
106 First cutting tool
107 Second controllable adjusting mechanism
108 Second cutting tool
109 Third controllable adjusting mechanism
110 Fourth transport path
111 Fifth transport path
112 Guide rollers
113 Guide rollers
114 First knife bar
115 Circular knife
116 Drum knife
117 Diverter element
118 Cardboard transport drive
119 Sixth controllable adjusting mechanism
120 Third guide rail
121 Seventh controllable adjusting mechanism
200 Third transport path
201 Third transport element
202 Circular knife
203 Second knife bar
204 Diverter element
205 Blank transport drive
206 Blank cylinder drive
207 Cross knife drive
300 Application nozzle
400 Blank cylinder
401 Blank gripper
402 Cardboard pusher
403 Joining roller
500 First bending line
501 First support rail
502 First turn-in rail
503 Fourth controllable adjusting mechanism
504 Second bending line
505 Second support rail
506 Second turn-in rail
507 Fifth controllable adjusting mechanism
600 Third transport element
601 Delivery device
700 Camera
701 Reading area
800 Data memory
801 First data line
802 Second data line
803 Third data line
900 Untrimmed cardboard sheet
901 Left case
902 Right case
903 Spine strip
904 Cardboard waste
905 Untrimmed blank sheet
906 Format waste
907 Corner waste
908 Case
a First transport speed
b Second transport speed
A First transport direction
B Second transport direction
C Third transport direction
D Fourth transport direction
E Fifth transport direction
F Sixth transport direction
G Discharge direction
H First distance
J Second distance
K Rotational axis of transport roller
L Surface area of cardboard sheet
M Surface area of case
N Surface area of spine strip
$\alpha$ Spread angle
$\beta$ Lead angle
$\gamma$ Left adjustment angle
$\delta$ Right adjustment angle
|| Cardboard transport plane

The invention claimed is:

1. An apparatus for the automated production of book cases and/or box lids, which is arranged in a machine frame and comprises a cardboard feed with a cardboard supply, a first separating mechanism that is arranged downstream of the cardboard supply in the product flow and a cardboard transport mechanism that has a first transport speed and comprises a first transport section with a first transport path, which extends in a first transport direction (A) and lies in a first cardboard transport plane, and with a first transport element that can be moved along the first transport path, and a cardboard cutting device with a first cutting mechanism that comprises a first cutting tool with a first cutting direction, which in a horizontal projection extends essentially parallel to the first transport direction (A) of the cardboard transport mechanism, and a first controllable adjusting mechanism that is connected to the at least one first cutting tool, wherein the first controllable adjusting mechanism is designed for varying the cutting position of the connected first cutting tool essentially transverse to the first cutting direction, and a second cutting mechanism that comprises a second cutting tool with a second cutting direction, which in a horizontal projection extends essentially parallel to the first transport direction (A) of the cardboard transport mechanism, and a second controllable adjusting mechanism that is connected to the second cutting tool, wherein the second controllable adjusting mechanism is designed for varying the cutting position of the connected second cutting tool essentially transverse to the second cutting direction, wherein one of the at least two cutting mechanisms of the cardboard cutting device is arranged between the first transport section and a second transport section of the cardboard feed, a blank feed with at least a blank supply, a second separating mechanism that is arranged downstream of the blank supply in the product flow and a blank transport mechanism that has a second transport speed and a third transport path, which is arranged in the blank transport plane and extends in a third transport direction (C), and with a third transport element that can be moved in the third transport direction (C) along the third transport path, a glue applicator that is arranged downstream of the at least one blank feed in the product flow and has a glue supply, a glue delivery mechanism and a glue metering mechanism assigned to the glue delivery mechanism, wherein at least the glue delivery mechanism is arranged along the blank feed, a joining device that is arranged downstream of the glue applicator in the product flow and has a positioning mechanism with a gripper that takes hold of the blank or of at least one cardboard, as well as a roll-down mechanism with a roller that extends essentially transverse to the blank transport direction (C), a turn-in device that is arranged downstream of the joining device in the product flow and has a first turn-in mechanism with at least one first turn-in element, which has a second working position and extends along a first bending line of the blank that in a horizontal projection is arranged essentially transverse to the third transport direction (C), and with a third controllable adjusting mechanism, which is connected to the first turn-in element and adjusts the second working position of the first turn-in element in a direction extending transverse to the first bending line, and a second turn-in mechanism with a second turn-in element, which extends along a second bending line of the blank that in a horizontal projection is arranged essentially parallel to the third transport direction (C), and with a fourth controllable adjusting mechanism, which is connected to the second turn-in element and adjusts the third working position of the second turn-in element in a direction extending transverse to the second bending line, a delivery unit with a third transport element that takes hold of and actively transports the finished book case or box lid, a control unit with a data memory and first data lines that are connected to the controllable adjusting mechanisms for their motor-driven adjustment to the working positions defined for the respective book case and/or box lid to be produced next in a time-adapted manner with the passage of the respective book cases or box lids and their assigned cardboards and blanks to be covered during ongoing production, and a reader that is connected to the control unit via a second data line, wherein said reader is arranged in the region of the cardboard feed such that its reading area lies within one of the first transport paths or one of the second transport paths or arranged in the region of the blank feed such that its reading area lies in a blank transport path, comprising at least one spreading device of the cardboard transport mechanism, which is arranged downstream of the first cutting mechanism in the product flow and has a fourth transport path extending in a fourth transport direction (D) and a fifth transport path extending in a fifth transport direction (E), wherein the fourth transport direction (D) and the fifth transport direction (E) are angled relative to one another by a spread angle (a) greater than 0°, a displacement element, which exerts upon at least one cardboard element a force acting transverse to its primary transport direction (B), a limitation of the fourth transport path in the form of a second guide rail, which is assigned to the fourth transport direction (D) of the spreading device and arranged in a variable fourth working position, wherein the second guide rail is connected to a fifth controllable adjusting mechanism that varies the fourth working position, and a limitation of the fifth transport path in the form of a third guide rail, which is assigned to the fifth transport direction (E) of the spreading device, extends parallel to the fifth transport direction (E) and is arranged in a variable fifth working position, wherein the third guide rail is connected to a sixth controllable adjusting mechanism that varies the fifth working position, and the fifth controllable adjusting mechanism and the sixth controllable adjusting mechanism are respectively connected to the control unit via a data line.

2. The apparatus of claim 1, wherein a rotational axis (K) and an element of the spreading device, which can be moved in an endlessly revolving manner, wherein the projection of the rotational axis (K) on the cardboard transport plane includes a lead angle (β) greater than 90° with the primary cardboard transport direction (B) and the endlessly revolving element has a curved section that is at least partially looped around the rotational axis (K).

3. The apparatus of claim 1, wherein a rotative knife of the first cutting tool with a cutting direction, wherein the rotational axis of the rotative knife is arranged essentially transverse to its cutting direction.

4. The apparatus of claim 1, wherein a discharge mechanism of the cardboard cutting device with a discharge direction (G), wherein the discharge direction (G) extends obliquely to the first transport direction (A) of the cardboard transport mechanism.

5. The apparatus of claim 4, wherein a guide element of the discharge mechanism that penetrates the cardboard transport plane.

6. The apparatus of claim 1, wherein a third cutting mechanism of the cardboard cutting device with a rotative cutting tool and a controllable drive of the rotative cutting tool, wherein the rotative cutting tool has a blade, which is arranged essentially transverse to the cardboard transport direction (A), and on an actively cutting circumference of the blade has at least intermittently a speed that differs from the first transport speed of the cardboard feed.

7. The apparatus of claim 1, wherein a first distance (J) of the cardboard cutting device from the joining device in the product flow and a second distance (H) of the reader arranged in the region of the blank feed from the joining device in the product flow such that a cardboard assigned to a blank located in the reading area of the reader is located in or upstream of the cardboard cutting device.

8. A method for the automated production of book cases and/or box lids of respectively a blank and an assigned set of cardboards by means of an apparatus for producing book cases or box lids, wherein said method comprises the steps of cyclically separating a blank from a blank supply by means of a controllable separating mechanism, transporting the separated blank to a glue applicator by means of a blank transport mechanism, applying glue on the joining surface of the separated blank in a laminar manner by means of the glue applicator, cyclically producing a set of cardboard elements assigned to the separated blank by cyclically separating a cardboard sheet by means of a controllable separating mechanism, transporting the separated cardboard sheet to a cardboard cutting device by means of a cardboard transport mechanism, cutting the separated cardboard sheet into at least two cardboard elements by means of a controllable cutting mechanism, detecting information carried by the blank by means of a reader, determining nominal values for processing parameters based on the information detected by the reader, and adjusting guides of the cardboard feed, which align the case boards and spine inserts, as well as the turn-in elements of the side turn-in mechanism, to the working positions defined for the respective case to be produced next in a time-adapted manner with the passage of the respective cases and their assigned case boards and their at least one assigned blank to be covered during ongoing production, wherein the surface area (L) of the one common cardboard sheet is greater than the sum of the surface areas (M, N) of the cardboard elements that are produced of this common cardboard sheet and required for the production of a case.

9. The method according to claim 8, characterized in that cardboard waste is moved out of the transport plane of the required cardboard elements in a discharge direction (G) after the cardboard elements required for the production of a case have been cut out of a common cardboard sheet.

* * * * *